United States Patent [19]

Hanson

[11] Patent Number: 4,646,529

[45] Date of Patent: Mar. 3, 1987

[54] TRANSPORT REFRIGERATION UNIT DEFROST CONTROL SYSTEM

[75] Inventor: Jay L. Hanson, Bloomington, Minn.

[73] Assignee: Thermo King Corporation, Minneapolis, Minn.

[21] Appl. No.: 822,181

[22] Filed: Jan. 24, 1986

[51] Int. Cl.[4] ..... F25D 21/06

[52] U.S. Cl. ..... 62/155; 62/156; 62/126; 62/162; 62/140

[58] Field of Search ..... 62/155, 156, 234, 140, 62/162, 126

[56] References Cited

U.S. PATENT DOCUMENTS

| | | | |
|---|---|---|---|
| 2,709,345 | 5/1955 | Ramsey | 62/162 X |
| 4,156,350 | 5/1979 | Elliott et al. | 62/155 X |
| 4,299,095 | 11/1981 | Cassarino | 62/155 |
| 4,302,947 | 12/1981 | Mueller et al. | 62/155 |
| 4,381,549 | 4/1983 | Stamp, Jr. et al. | 62/126 |
| 4,406,133 | 9/1983 | Saunders et al. | 62/155 X |
| 4,407,138 | 10/1983 | Mueller | 62/155 X |
| 4,432,210 | 2/1984 | Saito | 62/126 |

*Primary Examiner*—Harry Tanner
*Attorney, Agent, or Firm*—E. C. Arenz

[57] ABSTRACT

A solid-state defrost timer control for a transport refrigeration unit includes an oscillator 68, counter 66, flip-flop 74, and termination timer 88 which are provided with temperature reference signals from comparator U1, sensor failure condition signals from comparators U2 and U3, manual defrost and air switch defrost signals from switches S1 and S2, temperature set point signals from temperature set point device 42 and unit drive signals from line 64. Among the operating features are that the device will accumulate time only when the evaporator coil temperature is less than a pre-established temperature and will retain and hold time when the coil temperature is above the pre-established temperature.

7 Claims, 3 Drawing Figures

TRANSPORT REFRIGERATION UNIT DEFROST CONTROL SYSTEM

BACKGROUND OF THE INVENTION

This invention pertains to the art of transport refrigeration units, and in particular to a solid-state defrost control system for such a unit.

Various defrost control arrangements have been used in connection with transport refrigeration units. These include time-controlled defrost intervals and demand defrost control, as well as combinations of these.

The aim of this invention is to provide a solid-state defrost control system, relying principally upon a time-controlled defrost interval, and which has at least the following features. Sensing of the unit evaporator coil temperature is done with an electronic sensor, and the control system will continue to function even in the event of an open or a short of the sensor. Defrost time intervals of several different intervals can be selected easily, and a maximum defrost time is established. The system can include and be interfaced with a manual defrost mode, and an air switch backup mode, with protection in the case of a sticking air switch. The system has thermostat set point monitoring to determine when the timer is to be ON or OFF depending upon whether the set point for the space to be conditioned is below or above a pre-established temperature. The operation of the timer continues, regardless of the thermostat set point, if the sensor were to fail in either an open or short condition. When used with a refrigeration unit in which the drive for the unit is capable of ON/-OFF operation, the timer will stop and retain time when on the OFF cycle. The system provides time and temperature integration of defrost intervals when the thermostat set point is above a pre-established temperature and the device will accumulate time only when the evaporator coil temperature is less than that pre-established temperature, and will retain and hold the time when the evaporator coil temperature is above that pre-established temperature.

SUMMARY OF THE INVENTION

In accordance with the invention, the transport refrigeration unit is provided with a coil defrost control system which includes means for applying heat to the coil to defrost the coil, means for establishing a set point temperature for the space to be conditioned, means sensing the temperature of the coil and providing either an above-temperature signal or a below-temperature signal in response to coil temperatures above and below a temperature pre-established as desirable for the coil to reach in a defrosting operation, means for establishing a selected count corresponding to a selected time interval between defrosting operations when the unit runs continuously, means providing a set point temperature signal when said set point temperature is at or below the pre-established temperature, counting means operating in response to the existence of either the below-temperature signal or the set point temperature signal to generate a count signal at the end of the selected count to initiate a defrost operation through operation of the heat-applying means, means for normally terminating the defrost operation in response to the below-temperature signal being replaced by the above-temperature signal, defrost termination timer means responsive to the defrost initiation to generate a termination signal after a predetermined period in the absence of the above-temperature signal first effecting termination of the defrost operation, and means for clearing and resetting the counting means and the defrost termination timer means in response to the defrost operation termination.

DESCRIPTION OF THE PREFERRED EMBODIMENT

Figure 1:
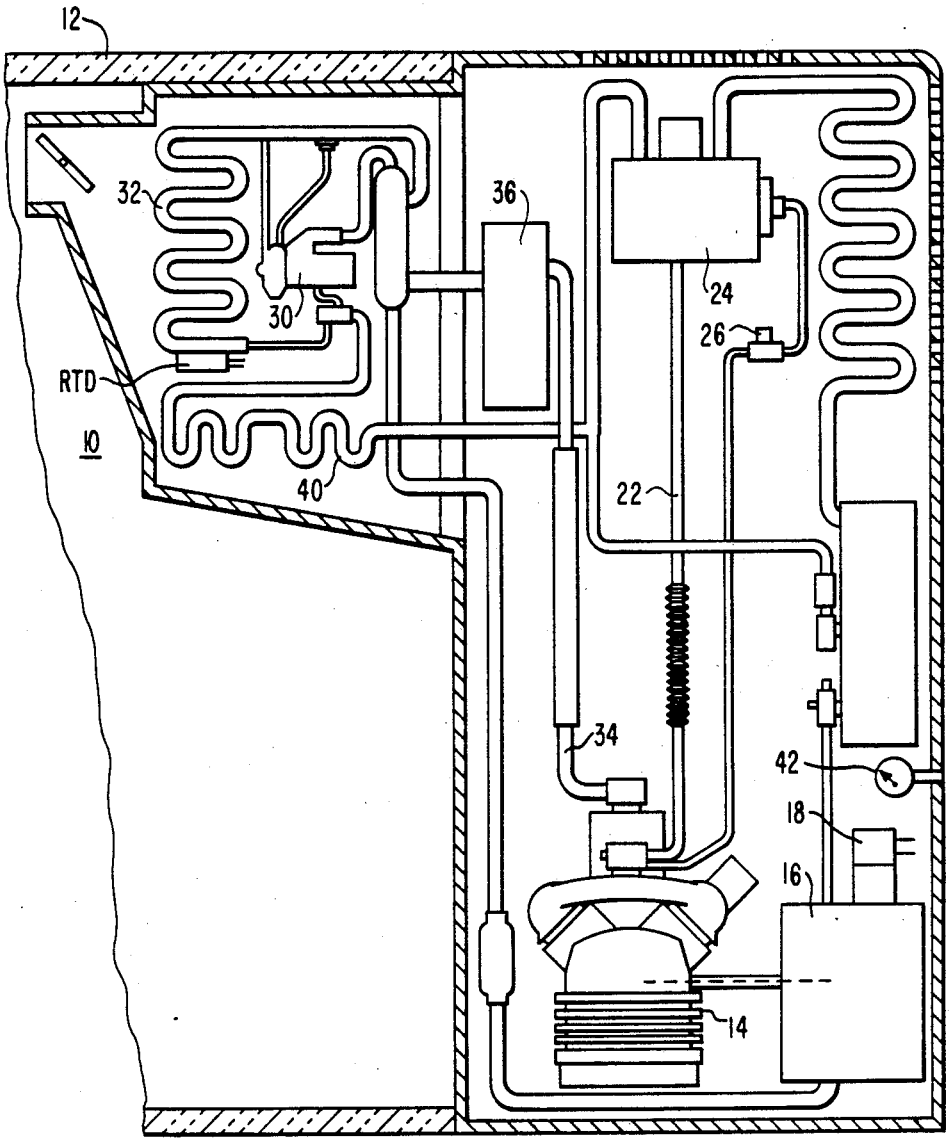
FIG. 1 is a schematic view of the main parts of a transport refrigeration unit of the type to which the invention can be applied for example.

Referring to FIG. 1, a transport refrigeration unit of basically conventional parts is provided to serve the space 10 within the insulated trailer 12 or the like. Most of the main parts are shown in schematic form since the system shown is considered conventional for purposes of this application and has been available from the assignee of this application.

A refrigerant compressor 14 is driven by a drive unit such as an internal combustion engine 16. It will be appreciated that the drive unit may alternatively be an electric motor if the unit is of the type which can be powered by either an engine or a motor. For purposes of example, the drive unit is an engine including a throttle with an electrically-operable solenoid 18 controlling the throttle.

The compressor 14 discharges hot gas through line 22 to the three-way valve 24 controlled by a pilot solenoid 26. In a cooling operation, the hot gas is passed through the condenser 28 where it is condensed and flows through the receiver and then through various lines and devices to an expansion valve 30, refrigerant evaporator 32 and back to the suction line 34 of the compressor through accumulator 36.

In either a heating or a defrosting operation, the pilot solenoid 26 is energized to move the three-way valve 24 to the opposite position so that the hot gas is discharged through line 38 to a defrost pan heater 40 and then through the evaporator 32, bypassing the expansion valve 30.

Means for providing airflow to the two sections of the refrigeration unit are not shown since they are readily known in the art. Basically, air from the served space 10 is drawn into the evaporator section and discharged back into the served space, while outdoor air is brought into the section with the condenser 28 and passes therethrough back to ambient. The refrigeration system thus far described is well known in the art.

Figure 2A:
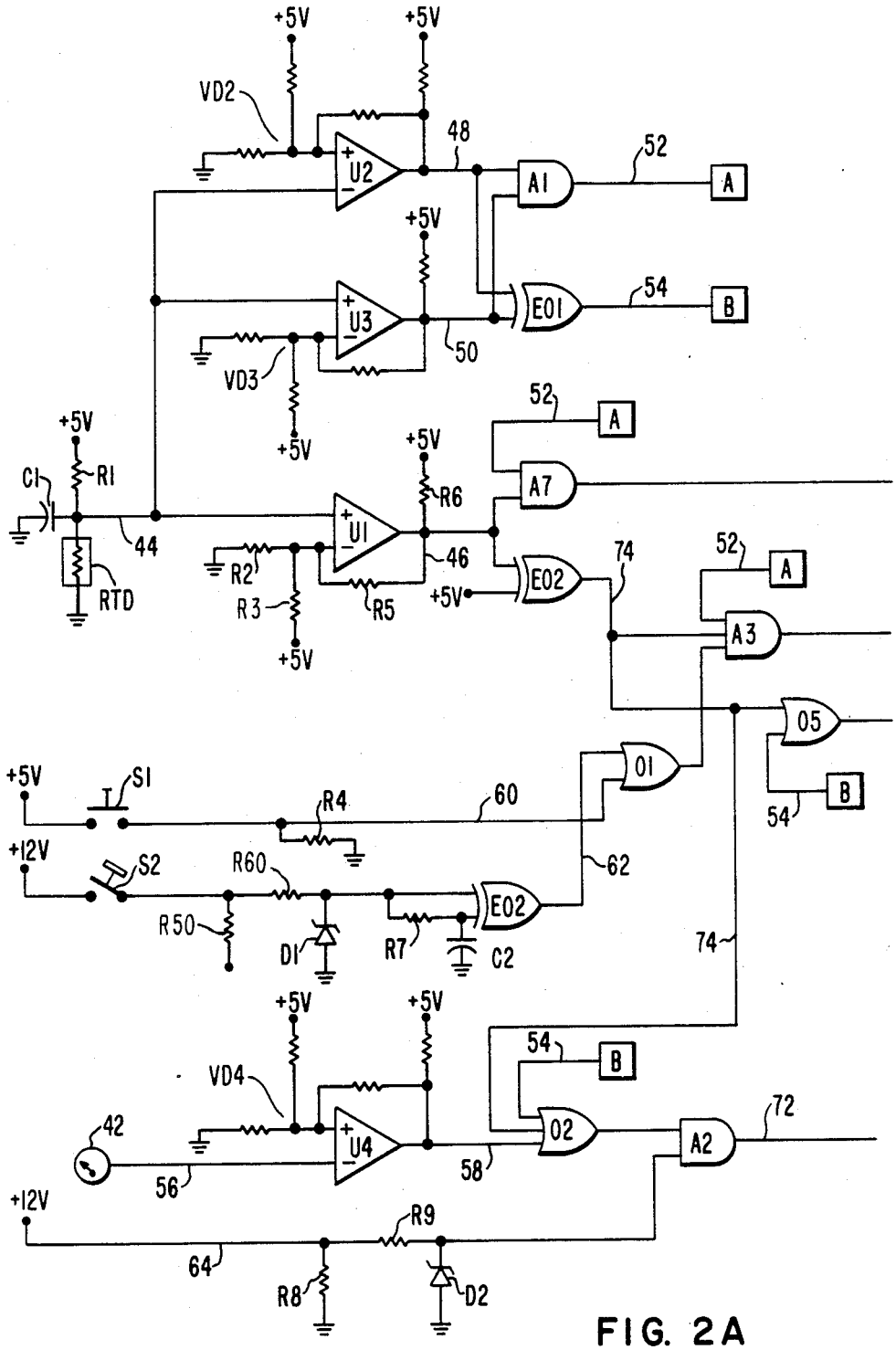
FIGS. 2A and 2B are parts of a schematic diagram of the currently preferred form of the system according to the invention.
Figure 2B:
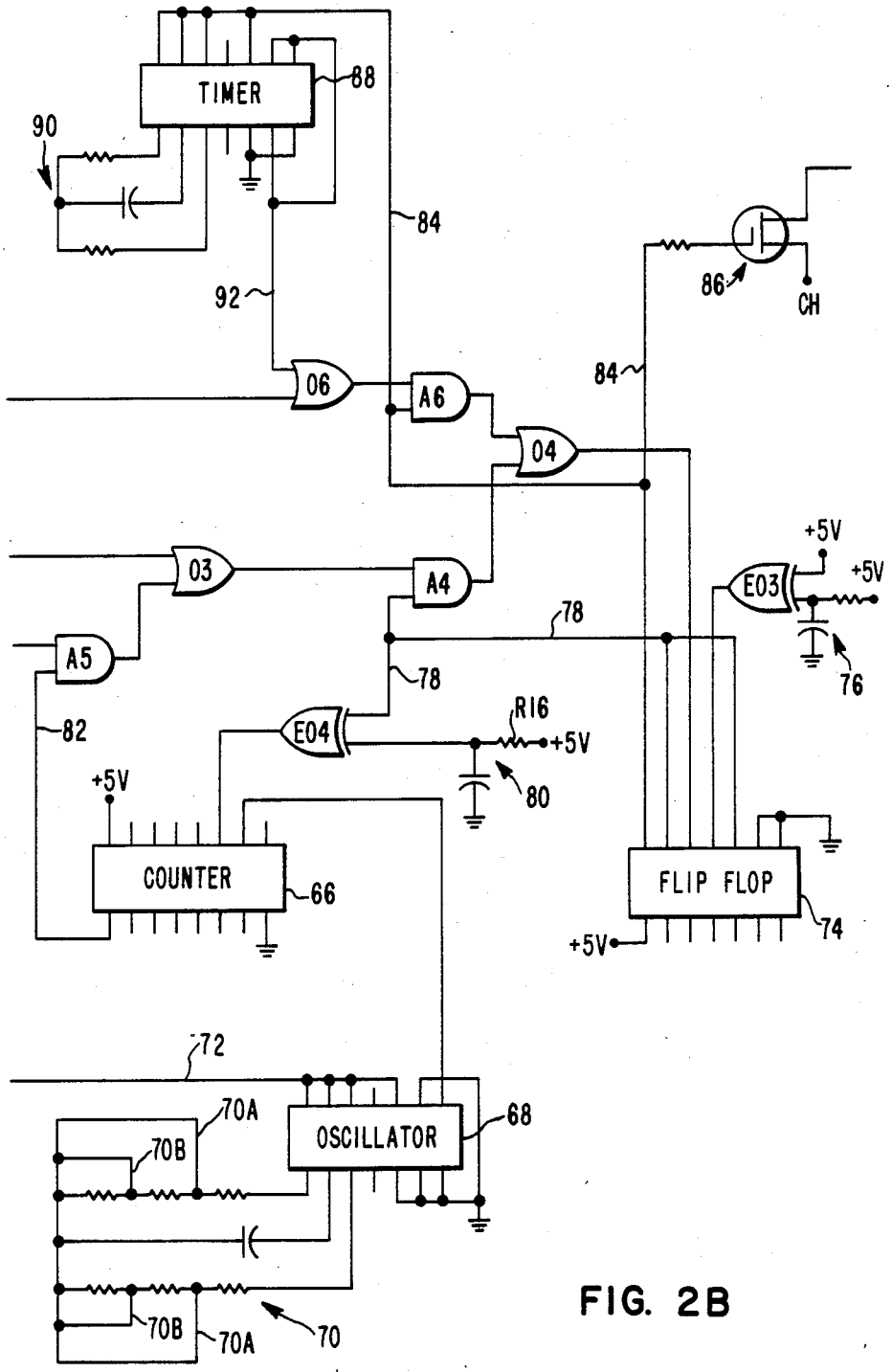

Several other elements shown in FIG. 1, and which will be referred to in connection with FIGS. 2A and 2B, include the evaporator coil temperature sensor RTD and a set point temperature element 42. This element is typically a potentiometer and is set to establish the desired space 10 temperature in the trailer.

The power supply for the main parts of the unit of FIG. 1 is twelve volts while the power supply for most of the logic elements of FIGS. 2A and 2B is a five-volt regulated supply.

Referring to FIGS. 2A and 2B, the coil temperature sensing element, RTD, is a resistance thermometer probe such as a Minco Products, Inc. Model S409, which has a temperature range which is well within the requirements for the logic circuit. The RTD sensor and resistor R1 form a voltage divider outputting to line 44, the voltage in this line changing with a temperature change of the evaporator coil temperature. Capacitor C1 is a filter capacitor used because of the long leads between the RTD sensor and the logic circuit.

A pre-established temperature, such as 45° F. (7° C.) is selected as being considered a desirable temperature for the coil to have reached by the end of its defrost. Resistances R2 and R3 form a voltage divider which outputs a voltage to one terminal of comparator U1 which is about the same as the voltage in line 44 when the coil temperature is at the pre-established 45° F. (7° C.), this voltage being applied to the other terminal of U1. Comparator U1, as well as each of the other comparators in the circuit, is provided with a feedback resistor R5 used to obtain an approximately 1.5° F. (0.8° C.) hysteresis to eliminate switch over hunt at the output of the comparator when the input from line 44 is at or near the 45° F. (7° C.) switch point, and also with a pull-up resistor R6 used because the comparator is an open collector device.

The changing voltage in line 44 at the positive input to the comparator U1 is compared to the fixed voltage at the negative input to the comparator, and when the evaporator coil temperature is above the pre-established temperature, the output of the comparator to line 46 goes high and when the coil temperature drops to below that pre-established temperature, the output will go low.

In the currently preferred form of the invention, it is desirable to have means to detect either an open or a short of RTD sensor. To this end, comparators U2 and U3 are provided and the voltage from line 44 is applied to the positive and terminal of U3 and the negative terminal of U2. Voltage dividers VD2 and VD3 output to the other terminals of the comparators U2 and U3. VD2 outputs a voltage of about 90% of the supply voltage while VD3 outputs a voltage of about 10% of the supply voltage so that both comparators have high outputs to lines 48 and 50 if the sensor has not failed. Both lines 48 and 50 are connected to AND gate A1 and exclusive OR gate E01 so that if the sensor has not failed, line 52 will be high while line 54 will be low.

Thermostat Setpoint Monitoring

The conditioned space thermostat used in conjunction with the defrost control system has a set point voltage output to indicate where the setpoint dial 42 is set. This output voltage is brought through line 56 to one terminal of comparator U4 which has the output of voltage divider VD4 connected to the other terminal with VD4 and U4 being arranged to give a high output when the space thermostat setpoint is at or below the pre-established temperature (45° F.) (7° C.) and a low output in line 58 when above the pre-established temperature.

Interface With Manual Defrost And Air Switch Controlled Defrost

It is usually considered desirable to provide for manual defrost which can override the timed defrost. To this end, a momentary switch S1 is provided to deliver voltage through line 60 to one terminal of OR gate 01. The resistor R4 is a pull-down resistor which pulls the input of the gate 01 to ground when the switch is open.

The air switch defrost control includes a switch S2 responsive to the pressure differential across the evaporator coil. If the frost on a coil builds up to a predetermined degree, the air switch S2 will close. The voltage supply to the air switch is the same twelve-volt supply from the unit battery. This is done because when the switch contacts close and call for defrost, some current is required through the contacts. The resistor R50 is used to limit the contact current to a relatively low value, and R50 also acts as a pull-down resistor for the exclusive OR gate E02 when the air switch is open. Resistance R60 and the zenor diode D1 are used to step down the twelve-volt input from the air switch to a value close to the five-volt supply for the logic circuit.

Gate E02 is used as a one shot that will turn the air switch closure into a pulse. When the air switch calls for defrost, the five volts is applied to the one terminal of E02 and the output in line 62 will switch from low to high and remain high until the time delay of R7 and C2 has timed out, at which time both inputs to the gate E02 will be high and the output will switch low.

Occasionally, problems have been experienced with the contacts of an air switch sticking closed. This would normally cause a unit to short cycle in and out of defrost. However, with the arrangement as described, in which the output of E02 goes low after a single one shot pulse of high, the unit will go into defrost from the air switch only once, even if the air switch contacts are stuck closed.

Drive Unit Operation Input

In the example of this application, the drive unit is an internal combustion engine. As such, it is provided with a fuel solenoid 18 (FIG. 1) which is energized by the unit twelve-volt battery. The twelve volts in line 64 (FIG. 2A) is derived from this energization of the fuel solenoid and is reduced to a compatible five-volt signal by the resistances R8 and R9 and the diode D2. Of course, if the prime mover were an electric motor, the twelve volts can be derived from the energization of the motor. The drive signal from this circuit is delivered to one terminal of AND gate A2. This drive signal arrangement is particularly useful in those units which are so called start/stop units in which the prime mover is de-energized for periods when the temperature in the condition space is at or very near the setpoint temperature, this arrangement conserving fuel and power.

Counting Means

The time interval between defrost is determined by a counter means 66 which in its currently preferred from is a twelve-stage binary counter, and a programmable timer oscillator 68. A resistor capacitor network generally designated 70 is connected to three pins of the oscillator and determine the oscillator frequency. The time interval between defrost operations is selectable in accordance with the presence or absence of jumpers 70A and 70B. As an example, with selected values of resistance and a capacitance, with the jumpers 70A and 70B in place, a four hour time interval is provided, while if the 70A jumper were removed, an eight hour time interval, and with 70B also removed, a twelve hour time interval, would occur, respectively. These time intervals are given by way of example only since they depend upon the resistance and capacitance values in the network 70.

To turn the oscillator and counter on requires a high output of AND gate A2 in line 72. One input high is available to A2 as the drive signal from line 64 indicating the unit is running. The other high input to A2 is from the output of triple OR gate O2 which receives a sensor condition signal from the line 54, a setpoint temperature signal from line 58, and a signal from line 74 derived from the coil temperature reference comparator U1 and inverted by exclusive OR gate E02. Thus the oscillator will oscillate at its predetermined frequency when the unit drive signal is present at the input to A2, and any of the following conditions exists through OR gate O2 to the other input of A2, namely the thermostat setpoint is 45° or less, the sensor has failed, or the evaporator coil is 45° or less.

The output frequency of the oscillator 68 is passed through line 66 and is the input frequency to the binary counter 66. The counter will accumulate time whenever the oscillator is oscillating and will retain the accumulated time when the oscillator is off.

An exclusive OR gate E03 is used to set a flip-flop 74 to the proper condition of no defrost during initial power up of the device. When power is applied, output of E03 will be high until the time delay of the resistance-capacitance 76 times out which will cause the output of E03 to go low. This momentary high pulse at the reset pin of the flip-flop at power up will force the $\overline{Q}$ pin high and Q pin low for a no-defrost condition.

A similar arrangement is used in connection with the counter 66 during power up to clear and reset the counter. At power up, with the flip-flop 74 having been put in the proper state of $\overline{Q}$ high and Q low, line 78 is high to the one input terminal of E04. The other input terminal will be low until the time delay 80 connected thereto times out. This momentary high pulse to the reset pin of the counter 66 at power up will clear and set the counter to zero time at start up. With the reset pin of counter 66 low after the time delay has timed out, the counter will count the pulses from the oscillator in binary sequential order. When the counter has accumulated the number of pulses corresponding to the selected time interval between defrosts, the pin connected to line 82 will go high and a defrost operation will be initiated if the conditions of the coil temperature being 45° F. or less, or the sensor has failed, exist. If these conditions for defrost are not met, that is, the evaporator temperature is above 45° F., the line 82 will remain high until the counter accumulates an additional number of pulses corresponding to a desired defrost interval. The reason the counter is not reset at the end of the count under these conditions is that the flip-flop will not have changed state as it does when a defrost occurs and accordingly, it cannot change back in state to deliver its clearing and resetting functions.

Defrost Initiation Circuits

Assuming the temperaure of the evaporator coil is less than, the pre-established defrost temperature, line 74 delivers a high to one terminal of triple input AND gate A3. With the sensor RTD not failed, A3 also receives a high from line 52. A third high is received by A3 from 01 if either the manual defrost switch is closed, or the air switch is closed. Thus, if either switch is closed, and the sensor has not failed, and the coil temperature is less than 45, a high will be outputted from A3 to OR gate 03 which outputs a high to one terminal of AND gate A4 whose other terminal is high, since it is connected through line 78 to $\overline{Q}$ of the flip-flop 74. The high output of A4 to OR gate 04 outputs a high to clock the flip-flop 74, which changes state with Q going high and $\overline{Q}$ going low. The high in line 84 connected to Q of the flip-flop energizes a power transistor 86 which in turn drives an external relay to energize the pilot solenoide 26 (FIG. 1) which switches the three-way valve 24 and initiates a hot gas defrost of the evaporator.

With line 78 (FIG. 2B), connected to $\overline{Q}$ of the flip-flop, being low in a defrost operation, any additional call for defrost such as a manual signal or an air switch signal will be defeated by the gate A4 so that defrost initiation is disabled when the unit is in defrost.

With the input to the gate E04 from the flip-flop being low, the output of E04 will be high to the reset pin of the counter 66. This will clear and set the counter to zero time and the counter will not accumulate time when the unit is in defrost.

The manner in which the defrost is initiated, whether by a manual signal, an air switch signal, or a count signal, is of no consequence since in each case the flip-flop functions in the way described to initiate the defrost cycle, the only difference being that the defrost initiation is through the circuit including OR gate O5 and AND gate A5 which are in a line parallel to the line between A3 and O3. A high signal cannot be delivered from A5 to O3 unless either the sensor has failed or the coil temperature is below the pre-established temperature. In the one case, a high is delivered to O5 through line 54 and in the other case, a high is delivered to O5 through line 74.

Defrost Termination Circuits

As has been stated, when defrost is initiated the flip-flop 74 changes state with Q going high and $\overline{Q}$ going low. With Q high, line 84 is high and starts the defrost termination timer 88 and also sets one input terminal of AND gate A6 high.

To terminate defrost, the evaporator coil temperature must rise above the pre-established 45° F. (7° C.) temperature or the timer 88 must time out in a predetermined time such as 30 minutes.

Assuming that the coil temperature rises above the pre-established temperature in less than the timer time period, the output of U1 goes high and this is inputted to AND gate A7 which also receives a high from line 52 indicating the sensor has not failed. The high output of A7 is passed to one input terminal of OR gate O6 which outputs a high to one input terminal of A6, whose other input is high because the unit is in a defrost cycle. The high output of A6 is inputted to the OR gate O4 which clocks the flip-flop 74 to change Q to low and $\overline{Q}$ to high and the defrost is terminated by line 84 to relay 86 going low.

The timer 88 is provided to limit the defrost time to a predetermined maximum as, in the case of the currently preferred embodiment, 30 minutes. This 30-minute time period is determined by the resistance-capacitance network 90 connected to the timer. If the evaporator coil temperature does not rise above the predetermined established temperature for the timer 88 times out, or a sensor has failed, the high output through line 92 to gate O6 will trigger the termination of the defrost operation in the same way in which defrost was triggered by the coil temperature rising above the pre-established temperature. With the Q pin of flip-flop 74 low, the timer 88 is cleared and reset to zero time, and the one input to AND gate A6 is low to prevent any false clocking of A6. With $\overline{Q}$ high, the output of E04 will be low which allows the counter 66 to start accumulating time, and AND gate A6 will be set with one input terminal high to permit a defrost initiation by either a clock signal, a manual signal, or an air switch signal.

It should be apparent from the description and the schematic that if any time a sensor fails, defrost is initiated at the end of a count from the counter to A5 since the output of O5 will be high because of the failed sensor irrespective of what the coil temperature is. The defrost will be terminated by the timer 88 at the end of the predetermined time, again irrespective of what the coil temperature is. Thereafter, the defrost will all be carried out and terminated on a timed basis, and the manual and air switch defrost will be disabled because of the low input from line 52 to A3.

I claim:

1. For a transport refrigeration unit adapted to condition a transportable space, and having unit driving means and an evaporator coil, a coil defrost control system comprising:

means for applying heat to said coil to defrost said coil;

means for establishing a set point temperature for said space;

means sensing the temperature of said coil and providing either an above-temperature signal or a below-temperature signal in response to coil temperatures above and below, respectively, a temperature pre-established as desirable for the coil to reach in a defrosting operation, said above-temperature signal normally precluding a defrost operation and said below-temperature signal normally permitting a defrost operation;

means for establishing a selected count corresponding to a selected time interval between defrost operations when said unit runs continuously;

means providing a set point temperature signal when said set point temperature is at or below said pre-established temperature;

counting means operating in response to the existence of either said below-temperature signal or said set point temperature signal to generate a count signal at the end of said selected count to initiate a defrost operation through operation of said heat applying means;

means for normally terminating said defrost operation in response to said above-temperature signal replacing said below-temperature signal;

defrost termination timer means responsive to said defrost initiation to generate a terminate signal after a predetermined period in the absence of said above-temperature signal first effecting termination of said defrost operation; and means for clearing and resetting said counting means and said defrost termination timer means in response to said defrost operation termination.

2. The system of claim 1 including:

means for determining failure of said coil temperature sensing means and providing sensor failure signal means to insure the continued operation of said counting means so long as said unit operates, irrespective of either of said above-temperature signal or below-temperature signal, and to permit successive defrost operations in response to said count signal.

3. The system of claim 1 including:

means providing a drive signal when said unit is operating; and said counting means requires the existence of said drive signal to operate to generate said count signal.

4. A system according to claim 2 including:

manually actuated means for initiating a defrost operation upon manual actuation, said manual means being connected in a circuit to bypass said counter means.

5. A system according to claim 4 including:

means responsive to little or no airflow through said coil for initiating a defrost operation, said airflow responsive means being connected in said circuit in parallel with said manually-actuated means.

6. A system according to claim 5 including:

means disabling said circuit bypassing said counter means in response to failure of said coil temperature sensing means providing said sensor failure signal means.

7. A system according to claim 1 wherein:

said clearing and resetting means includes a flip-flop having one output state for initiating a defrost operation and starting said defrost termination timer means, and another output state for clearing and resetting said counting means and said defrost termination timer means.

* * * * *